US005936216A

United States Patent [19]

Wu

[11] Patent Number: 5,936,216

[45] Date of Patent: Aug. 10, 1999

[54] FROTH FLOATATION PROCESS FOR SEPARATING CARBON FROM COAL ASH

[76] Inventor: Chiung-Hsin Wu, 11F-4, No. 141, Chung-Shan-Erh Rd., Ling-Ya Dist., Kaohsiung City, Taiwan

[21] Appl. No.: 09/201,763

[22] Filed: Dec. 1, 1998

[51] Int. Cl.[6] ..... B03B 9/04; B03D 1/02

[52] U.S. Cl. ..... 209/164; 209/166; 209/17; 209/3; 241/24.24; 106/705; 106/DIG. 1

[58] Field of Search ..... 209/3, 17, 164, 209/166; 106/705, DIG. 1; 241/24.24

[56] References Cited

U.S. PATENT DOCUMENTS 1,984,386 12/1934 Tshcudy .
2,136,074 11/1938 Crawford .
4,121,945 10/1978 Hurst .
4,426,282 1/1984 Aunsholt .
4,652,433 3/1987 Ashworth .
5,047,145 9/1991 Hwang .
5,227,047 7/1993 Hwang .
5,817,230 10/1998 Groppo .

FOREIGN PATENT DOCUMENTS 3842851 5/1990 Germany .

*Primary Examiner*—Thomas M. Lithgow
*Attorney, Agent, or Firm*—Dickinson Wright PLLC

[57] ABSTRACT

A froth floatation process for separating carbon from coal ash incorporates a step of screening the coal ash before the coal ash is formed into a slurry.

8 Claims, 3 Drawing Sheets

FROTH FLOATATION PROCESS FOR SEPARATING CARBON FROM COAL ASH

BACKGROUND OF THE INVENTION

1. Field of the Invention

This invention relates to the separation of carbon from coal ash, more particularly to a froth floatation process for separating carbon from coal ash.

2. Description of the Related Art

Coal ash formed from burning pulverized coal in a furnace usually contains two types of ashes, namely bottom ash and fly ash. The chemical content and particle size of these ashes vary wildly in accordance with the source of coal and the burning conditions of the furnace. The coal ash comprises carbon and mineral materials therein, and normally can be utilized as a mineral admixture for use in the manufacture of Portland cement. However, such usage requires the fly ash to have a carbon content below a level standardized for the Portland cement. The fly ash having a high carbon content may cause undesirable reduction in entrained air in concrete, and exhibits a decrease in desirable pozzolanic reactivity. Such fly ash fails to meet the specification of the Portland cement and can't be reused. Additional cost is necessary for disposal of the fly ash.

As for the bottom ash, although it has similar chemical content as the fly ash, it usually contains larger particle size, higher contents of carbon and coal tar, and has a higher density than the fly ash. The bottom ash normally can't be reused without further treatment, and has to be disposed as waste which will cause disposal problems and environment concerns.

Froth floatation process for the processing of a fly ash has been known in the art. In this process, the carbon of the fly ash is frothed up, and the non-frothed part of the fly ash, which is dominated by mineral materials settls down. Thus, the carbon and the mineral materials which are originally mixed together in the fly ash can be separated. The conventional froth floatation process generally comprises the steps of: adding the fly ash into a mixing tank containing a slurrying liquid to form a slurry; adding a floatation reagent to the slurry to condition the slurry and form the carbon of the fly ash into a hydrophobic carbon; and supplying air bubbles to froth the hydrophobic carbon upwardly to the surface of the slurry, and simultaneously settling the non-frothed part of the fly ash to the bottom of the slurry. The hydrophobic carbon frothing on the surface of the slurry, and the non-frothed part of the fly ash settling on the bottom of the slurry are subsequently removed for recovery. Although the conventional froth floatation process permits removable of the carbon from the fly ash, it has disadvantages in that the carbon can't be efficiently separated from the fly ash, and that the non-frothed part of the fly ash can't have a low carbon level suitable for reuse, for example, in the manufacture of the Portland cement.

The prior art has suggested that the removable of the carbon from the fly ash may be improved by adding an excess amount of the floatation reagent to the slurry in the froth floatation process. However, such a step is impractical due to the increase in the cost of the froth floatation process.

SUMMARY OF THE INVETNION

Therefore, it is an object of the present invention to provide an efficient froth floatation process for separating carbon from coal ash. Accordingly, the process of the present invention comprises the steps of: screening the coal ash into a plurality of ash fractions having narrow ranges of particle size distribution; forming individually each of the ash fractions into a slurry by adding a predetermined amount of a slurrying liquid; adding a floatation reagent to the slurry to condition the slurry so as to form the carbon of each of the ash fractions into a hydrophobic carbon; and aerating the conditioned slurry with air for frothing the hydrophobic carbon upwardly to the surface of the slurry, thereby separating the carbon from the coal ash.

BRIEF DESCRIPTION OF THE DRAWING

In drawings which illustrate embodiments of the invention.

DETAILED DESCRIPTION OF THE PREFERRED EMBODIMENT

Figure 1:
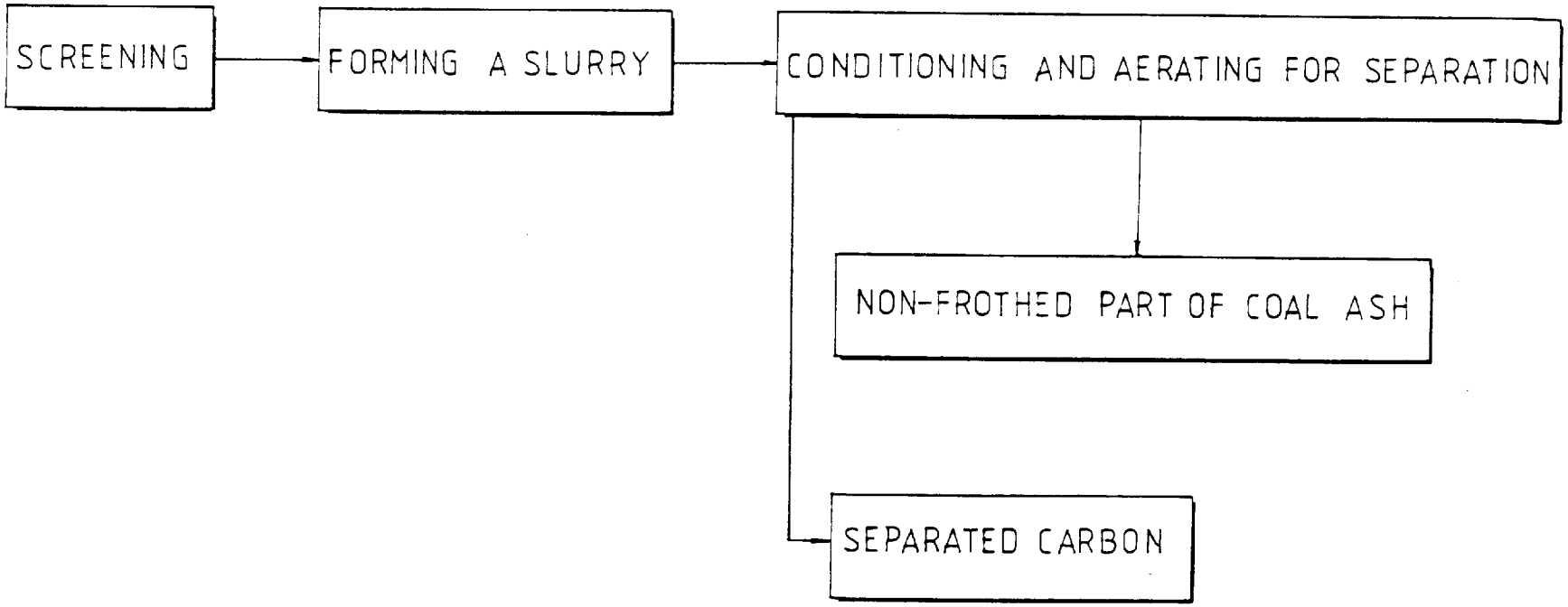
FIG. 1 is a block diagram illustrating an embodiment of the process of the present invention.

As illustrated in FIG. 1, the preferred embodiment of a froth floatation process according to the present invention comprises the following steps: (1) screening ; (2) slurry forming; and (3) conditioning and aerating.

Figure 2:
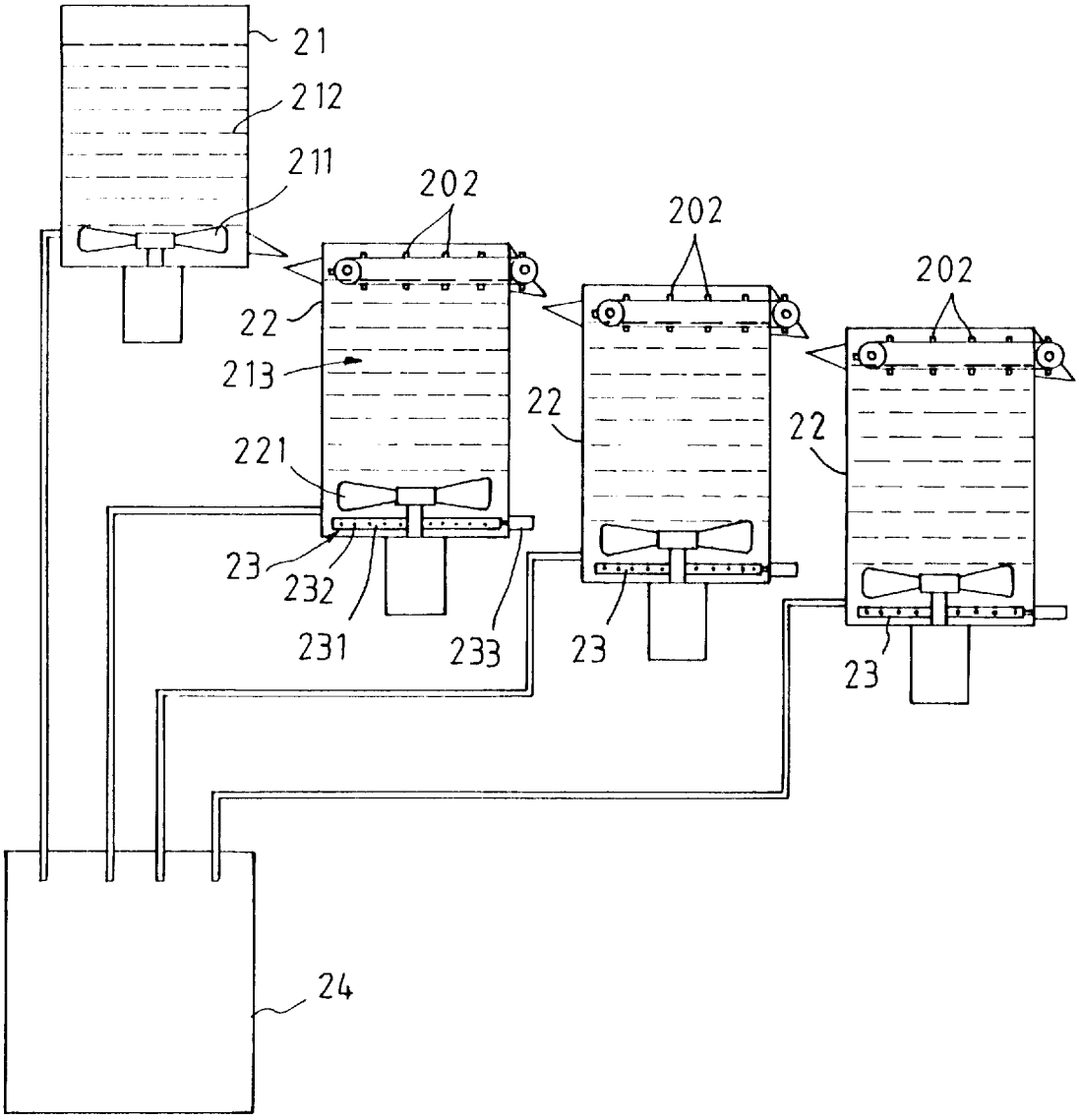
FIG. 2 is a schematic view showing a pre-mixing tank and a series of floatation tanks used in the process of the present invention.

Referring now to FIG. 1 and FIG. 2, coal ash having a broad distribution of particle size is screened into a plurality of ash fractions by a stack of screens so that each of the ash fractions has a narrow range of particle size distribution after screening. The range of the particle size distribution for each of the ash fractions is preferably arranged to be as narrow as possible. In an embodiment of the invention, the fly ash is screened via a stack of screens in which the mesh number difference between adjacent screens is 100 mesh or less, so that the ash fractions include a first fraction with a particle size of over 100 mesh, a second fraction with a particle size of 101 to 200 mesh, a third fraction with a particle size of 201 to 300 mesh, and a fourth fraction with a particle size of below 300 mesh. The bottom ash generally has a large particle size, so that grinding of bottom ash is needed before the screening step. The particle size of the ground bottom ash is preferably less than 200 mesh.

Figure 3:
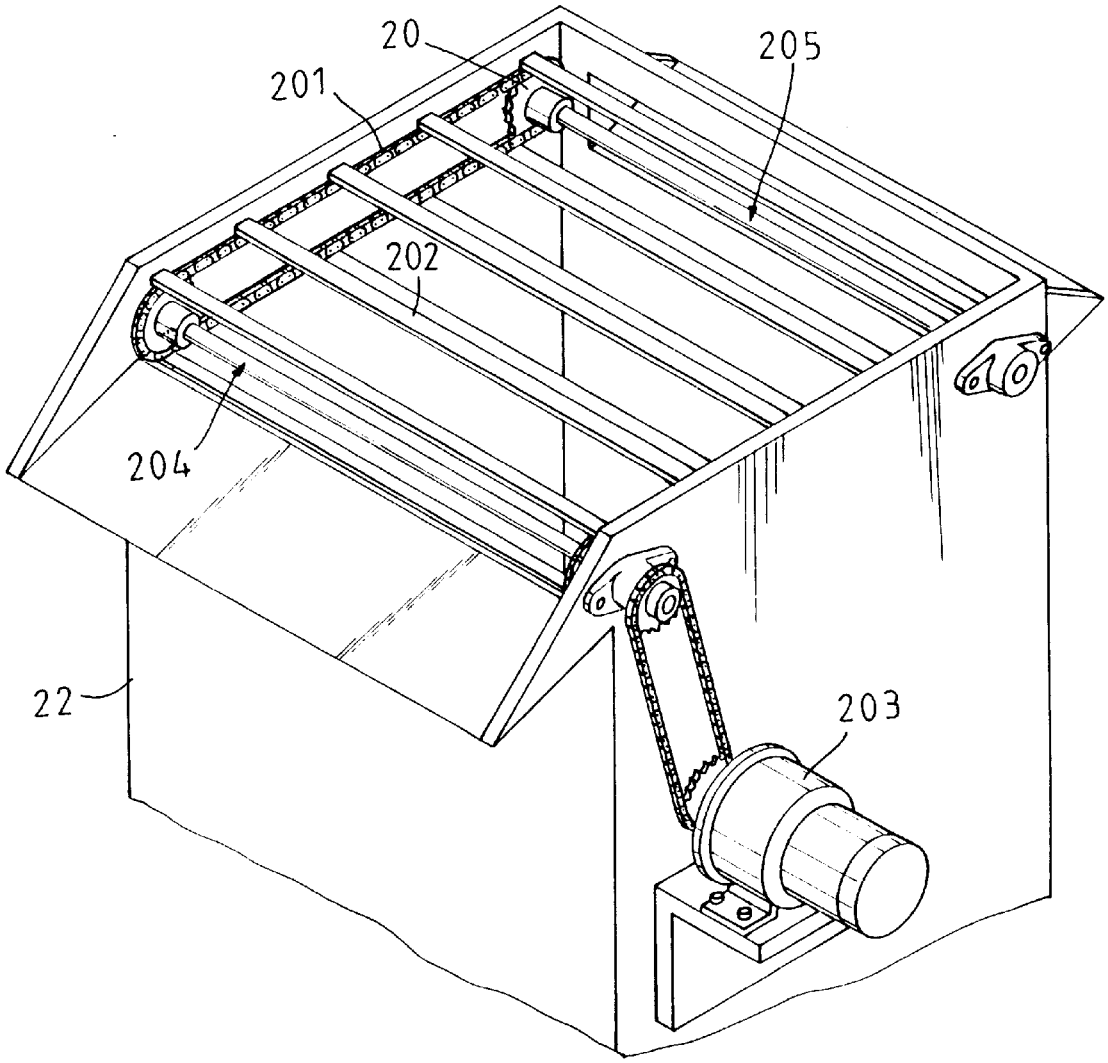
FIG. 3 is a perspective view of the floatation tank with a skimming device shown in detail.

Each of the ash fractions is added to a premixing tank 21 with a slurrying liquid 212 to form a slurry 213. The weight ratio of the slurrying liquid to the ash fraction is preferably in the range of 1:3 to 1:5. The pre-mixing tank 21 is provided with a stirrer 211 at the bottom of the pre-mixing tank 21 for stirring the slurry to a uniform state. Once a uniform slurry is obtained in the pre-mixing tank 21, the slurry is continuously transferred to a plurality of floatation tanks 22 which are connected to the pre-mixing tank 21. The slurry is conditioned in the floatation tank 22 by adding a floatation reagent into the slurry 213. The carbon present in each ash fraction is formed into a hydrophobic carbon by the floatation reagent. The floatation tank 22 is provided with a stirrer 221 situated at the bottom of the floatation tank 22 for stirring the slurry, an air diffuser 23 beneath the stirrer 221 for generating air bubbles, and a skimming device having a plurality of scrapers 202 on top of the floatation tank 22. The air diffuser 23 comprises a tube 231 provided with a plurality of holes 232 in the tube wall thereof and connected to an air supplying device 233 so as to generate air bubbles in the floatation tank 22. The conditioned slurry is aerated by introducing air bubbles from the air diffuser 23 into the slurry to froth the hydrophobic carbon upwardly to the surface of the slurry in the floatation tank 22. The non-frothed part of the coal ash settles to the bottom of the floatation tank 22 by gravity. The frothed hydrophobic carbon on the surface of the slurry 213 is skimmed off from the top of the floatation tank 22 by the scrapers 202 of the skimming device situated on top of the floatation tank 22 as best shown in FIG. 3, so as to remove the carbon.

In the skimming device, the plurality of spaced apart scrapers 202 have opposing ends mounted on two opposite chains 201, respectively. The chains 201 are driven by two pairs of chain sprockets 20 which are mounted on the opposing side walls of the floatation tank 22 adjacent to the top of the floatation tank 22. The two pairs of the chain sprockets are connected by two rods 204, 205, as shown in FIG. 3. The chain sprockets 20 are driven concurrently by a drive motor 203 so that the scrapers 202 move along the path of the chain 201 and skim off the hydrophobic carbon from the top of the floatation tank 22. The non-frothed part of each of the ash fractions that settles on the bottom of the floatation tank 22 is withdrawn to a collecting tank 24 shown in FIG. 2.

By incorporating a screening step in the froth floatation process described above, i.e., by narrowing the range of the particle size distribution of the coal ash, the carbon can be effectively removed from the coal ash. The coal ash treated by the floatation process of this invention results in a low carbon content and meets the standard set forth in the ASTM c-618-92a. Moreover, since the frothed layer formed in the floatation tank 22 connected to the pre-mixing tank 21 may contain some mineral materials associated with the hydrophobic carbon, these mineral materials can be removed from the frothed layer by subjecting the frothed layer to further separation steps in additional floatation tanks 22 which are arranged in series, as shown in FIG. 2. According to the process of the invention, the combustion loss (carbon content) of a coal ash can be reduced to 2% ±1.

With the invention thus explained, it is apparent that various modifications and variations can be made without departing from the spirit of the present invention. It is therefore intended that the invention be limited to only as recited in the appended claims.

I claim:

1. A froth floatation process for separating carbon from coal ash, said process comprising the steps of:

screening said coal ash into a plurality of ash fractions having narrow ranges of particle size distribution by means of a screening device;

forming individually each of said ash fractions into a slurry by adding a predetermined amount of a slurrying liquid;

conditioning said slurry to obtained conditioned slurry by adding a floatation reagent to said slurry so as to form said carbon of each of said ash fractions into hydrophobic carbon; and aerating said conditioned slurry with air for frothing said hydrophobic carbon upwardly to the surface of said slurry, thereby separating the carbon from the coal ash of said slurry.

2. The process of claim 1, wherein said process further comprises removing said frothed hydrophobic carbon from the top of said frothed slurry, and removing the non-frothed part of the coal ash from the bottom of said frothed slurry.

3. The process of claim 1, wherein said screening device contains a plurality of stacked screens, the mesh number difference between adjacent ones of said screens being within 100 mesh.

4. The process of claim 1, wherein said coal ash is fly ash.

5. The process of claim 1, wherein said coal ash is bottom ash, said bottom ash being ground before the step of screening said coal ash.

6. The process of claim 5, wherein said ground bottom ash has a particle size of below 200 mesh.

7. The process of claim 1, wherein said slurrying liquid and said ash fraction are added into a pre-mixing tank to form said slurry, and said floatation reagent is added into a floatation tank after said slurry is fed from said pre-mixing tank into said floatation tank.

8. The process of claim 1, wherein the ratio of said slurrying liquid to said ash fraction is in the range of 1:3 to 1:5.

* * * * *